United States Patent [19]

Fukazawa et al.

[11] 4,449,039

[45] May 15, 1984

[54] CERAMIC HEATER

[75] Inventors: Takeshi Fukazawa, Kariya; Shunzo Yamaguchi, Okazaki; Morihiro Atsumi, Toyohashi, all of Japan

[73] Assignee: Nippondenso Co., Ltd., Kariya, Japan

[21] Appl. No.: 415,547

[22] Filed: Sep. 7, 1982

[30] Foreign Application Priority Data

| | | | |
|---|---|---|---|
| Sep. 14, 1981 | [JP] | Japan | 56-144970 |
| Oct. 8, 1981 | [JP] | Japan | 56-160817 |
| Oct. 8, 1981 | [JP] | Japan | 56-160818 |

[51] Int. Cl.[3] ..... H05B 3/10

[52] U.S. Cl. ..... 219/553; 219/270; 219/541; 252/507; 252/513; 252/516; 252/520; 338/330; 361/266

[58] Field of Search ..... 219/270, 541, 553; 338/329, 330; 361/266; 252/507, 508, 513, 516, 518, 519, 520, 521; 428/428

[56] References Cited

U.S. PATENT DOCUMENTS

| | | | |
|---|---|---|---|
| 3,895,219 | 7/1975 | Richarson | 219/553 |
| 3,996,168 | 12/1976 | Hoffmann et al. | 252/520 |
| 4,029,828 | 6/1977 | Bildstein et al. | 252/520 X |
| 4,060,663 | 11/1977 | Merz et al. | 428/428 |
| 4,094,061 | 6/1978 | Gupta et al. | 29/612 |
| 4,098,725 | 7/1978 | Yamamoto et al. | 252/519 |
| 4,107,510 | 8/1978 | Tombs et al. | 219/270 |
| 4,341,965 | 7/1982 | Okuo et al. | 252/516 X |

FOREIGN PATENT DOCUMENTS 55-51777 1/1980 Japan .

*Primary Examiner*—Volodymyr Y. Mayewsky
*Attorney, Agent, or Firm*—Cushman, Darby & Cushman

[57] ABSTRACT

A ceramic heater having a heating element of a sintered mixture comprising alumina and titanium nitride and/or titanium carbide. The heating element has a specific resistance in a range from $10^{-4}$ to several Ωcm. The ceramic heater may have supporting substrates of insulating materials with which the heating element is covered. The ceramic heater can be used at a temperature above 1000° C.

7 Claims, 8 Drawing Figures

CERAMIC HEATER

BACKGROUND OF THE INVENTION

1. Field of the Invention

The present invention relates to a ceramic heater and more particularly to a heating element of sintered bodies, and a conformation of the heating element and covering substrates.

2. Description of the Prior Art

Conventionally, nickel-chromium alloy has been widely used as a heating element for heating or ignition use. Non-metallic heating elements composed of such materials as silicon carbide, zirconia, molybdenum silicide, lanthanum chromite, and carbon are also commercially available.

As nickel-chromium alloy is easily oxidized, the heating element composed of the alloy is used under limited conditions. Also the element when used in a relatively good condition may decrease gradually in cross sectional area by oxidation.

This, in turn, will give rise to severe local heating, which may result in self burn-out of the element.

Non-metalic materials described above are not so widely used as is nickel-chromium alloy because of their low oxidation resistance or high fabrication cost.

PRIOR ART STATEMENT

Japanese published unexamined patent application Sho-55-51777 published Apr. 15, 1980 discloses a heater having a ceramic supporting substrate and a heater element sintered thereon. The supporting substrate is a sintered silicon nitride and the heater element is molybdenum and/or wolfram (tungsten). Molybdenum and wolfram are both metals so they are easily oxidized. For example, wolfram is oxidized easily in a moist atmosphere. The oxidation begins at 300° C. and rapidly progress above 500° C. as to form wolfram oxide ($WO_3$). This wolfram oxide has a sublimating point of 800° C. so that it sublimates quickly, therefore the heating temperature of the heater is limited to a low level when used.

Also there is such a tendency that the printed elements sometimes separate from the surface of the supporting substrates by thermal-shock when used.

SUMMARY OF THE INVENTION

It is therefore, a primary object of the present invention to provide a ceramic heater with a heating element having oxidation resistance.

It is another object of the present invention to provide a long-life ceramic heater which does not break by thermal-shock.

Accordingly, the invention provides a ceramic heater having a heating element of a sintered mixture comprising alumina and titanium nitride and/or titanium carbide. The ceramic heater may have a supporting substrate of insulating materials with which the heating element is covered.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

GENERAL DESCRIPTION OF THE PREFERRED EMBODIMENTS

Figure 1:
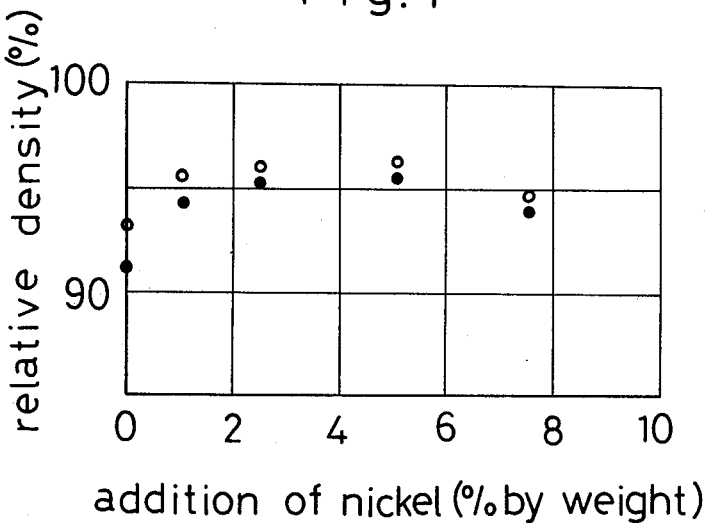
FIGS. 1 and 2 are graphs showing the relative densities of the sintered bodies containing various amount of nickel.

The ceramic heater of the present invention has a sintered element of a powdery mixture comprising alumina, titanium nitride and/or titanium carbide.

In this invention, the ceramic heaters are defined to include a sintered heating element bonded to or covered with a supporting substrate as well as a heating element consisting of only a sintered body.

The ceramic heaters of the present invention are characterized by a sintered body obtained by sintering a powdery mixture of alumina, titanium nitride and/or titanium carbide.

As is well known, titanium nitride and titanium carbide have superior mechanical strength at high temperatures, and excellent thermal stability, as easily understood by their use as main ingredient of cermets used for anti-friction parts and cutting tools such as throw-away tips. They have a low coefficient of thermal expansion as $9.3\times10^{-6°}$ C.$^{-1}$ and $7.6\times10^{-6°}$ C.$^{-1}$ However, titanium nitride and titanium carbide have low specific electrical resistances: $\sim10^{-5}\Omega$cm at room temperature, $\sim10^{-4}\Omega$cm at 1000° C. Such resistances are too small for a heating element, and the thermal stabilities are not sufficient. The inventors have found that the specific resistances of sintered bodies can be controlled by mixing alumina with titanium nitride and/or titanium carbide for the raw materials, and completed the present invention.

This sintered body makes an effective increase of the specific resistance to a level suitable as a heating element. For example, the specific resistance of a sintered body made of titanium nitride in 100% by weight (hereafter, % means % of weight) is $9.4\times10^{-5}\Omega$cm, while the addition of alumina in 20%, 50%, 70%, 80%, and 90% to titanium nitride results sintered bodies with the specific resistance of 0.00012, 0.00073, 0.0065, 0.18, and 2.7Ωcm, respectively. Also, the specific resistance of titanium carbide itself is $2.5\times10^{-5}\Omega$cm, while the addition of alumina in 20%, 50%, 70%, 80%, and 90% makes sintered bodies with the specific resistance of 0.00017, 0.0013, 0.0043, 0.0062, and 3800Ωcm, respectively. The ranges of compositions usable for heating elements are 2–80% for titanium nitride and/or titanium carbide 20–98% for alumina: the total is 100%. The preferred ranges are 5–50% for titanium niuride and/or titanium carbide and 50–95% for alumina. The specific resistance of sintered bodies with these compositions is in a range from $10^{-4}$ to several Ωcm, which is preferable for heating elements.

In sintered bodies for heating elements of the present invention, the addition of 0.05–5% magnesium oxide to titanium nitride and/or titanium carbide and alumina is effective to produce ceramic heaters with a constant quality.

Magnesium oxide acts to suppress the abnormal crystal growth of alumina, and effectively decreases distortion of titanium nitride and/or titanium carbide involved in the grain boundary movement, which is caused by the excessive growth of alumina crystals. Thus, magnesium oxide can prevent the element from local heating. However, magnesium oxide in excess of 5% may decrease the strength of the sintered bodies.

Addition of about 0.05–7.5% of nickel to titanium nitride and/or titanium carbide and alumina can provide more dense sintered bodies, decrease the dependancy of the specific resistance on the sintereng temperatures, and improve their life as a ceramic heater. The sintered bodies having nickel may be densified even at a sintering temperature of 1650°–1850° C., although alumina itself has a melting point of approximately 2050° C.

Figure 2:
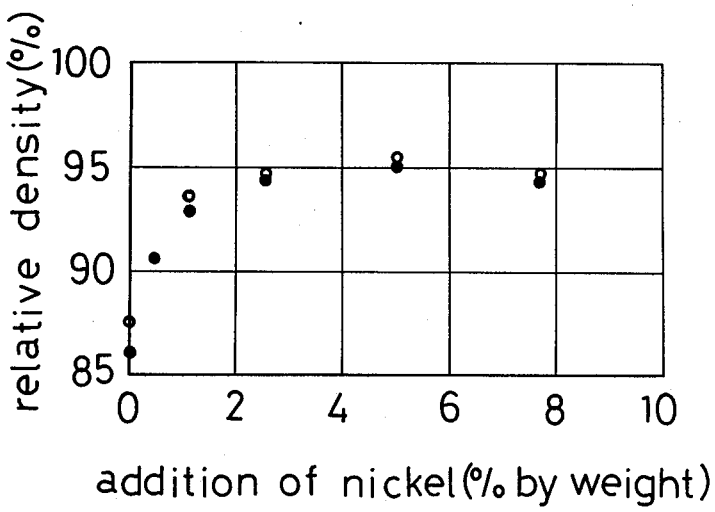

Added nickel helps to densify the sintered bodies. For reference, the relationship between the relative densities of the sintered bodies and nickel contents is illustrated in FIGS. 1 and 2, wherein two groups, $Al_2O_3$-30TiN(-TiC)-xNi (alumina (70−x)%, titanium nitride or titanium carbide 30%, nickel x%) and $Al_2O_3$-30TiN(TiC)-1MgO-xNi(alumina (69−x)%, titanium nitride or titanium carbide 30%, magnesium oxide 1%, nickel x%), are sintered at 1770° C. in an argon atmosphere for two hours. FIG. 1 shows the results of the sintered bodies containing titanium nitride and FIG. 2 shows the one containing titanium carbide. In FIGS. 1 and 2, the ordinates show the relative density (%), the abscissas show the nickel content(%), and the black dots indicate the values of $Al_2O_3$-30TiN(TiC)-xNi groups, and the white dots those of $Al_2O_3$-30TiN(TiC)-1MgO-xNi groups. As shown in FIGS. 1 and 2, the relative densities of the sintered bodies increase when 7.5% or less of nickel is added. However, when nickel is added in excess of 7.5%, the sintered body oozes with nickel which will evaporate and leave pores in the sintered body. Thus, the relative density decreases, and the specific resistance of the sintered body shows a marked increase.

To illustrate the role of the nickel addition which decreases the effect of sintering temperature upon the specific resistance of the sintered body, Table 1 shows the relation between the sintering temperature and the specific resistance, when a mixture of 66.5% for alumina, 30% for titanium nitride or titanium carbide, 1% for magnesium oxide, and 2.5% for nickel: was sintered at various temperatures from 1650° C. to 1850° C. in 50° C. intervals.

TABLE 1

| sintering temperature (°C.) | 1650 | 1700 | 1750 | 1800 | 1850 |
|---|---|---|---|---|---|
| specific resistance (Ωcm) 66.5$Al_2O_3$—30TiN—1MgO—2.5Ni | $1.3 \times 10^{-2}$ | $2.5 \times 10^{-3}$ | $2.1 \times 10^{-3}$ | $1.8 \times 10^{-3}$ | $9.9 \times 10^{-4}$ |
| specific resistance (Ωcm) 66.5$Al_2O_3$—30TiC—1MgO—2.5Ni | $8.8 \times 10^{-3}$ | $1.6 \times 10^{-3}$ | $1.3 \times 10^{-3}$ | $1.1 \times 10^{-3}$ | $7.5 \times 10^{-3}$ |

As shown in Table 1, at higher sintering temperatures, the specific resistance tends to decrease, and yet, it may be noticed that the specific resistance is substantially stable in the sintering temperature range from 1700° C. to 1800° C.

Figure 3:
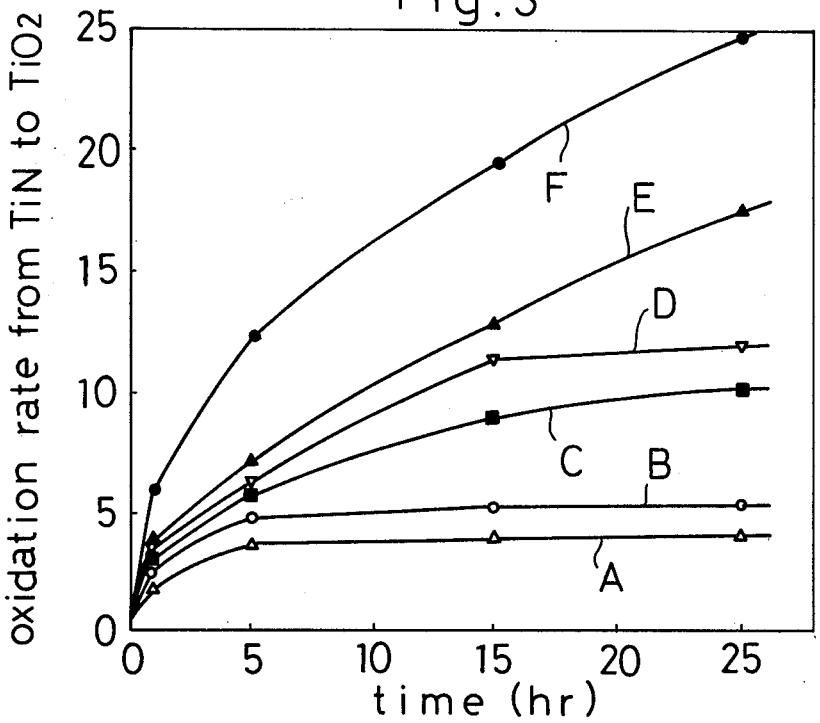
FIGS. 3 and 4 are graphs showing oxidization rates of of fourteen kinds of sintered bodies, in process of exposure time.
Figure 4:
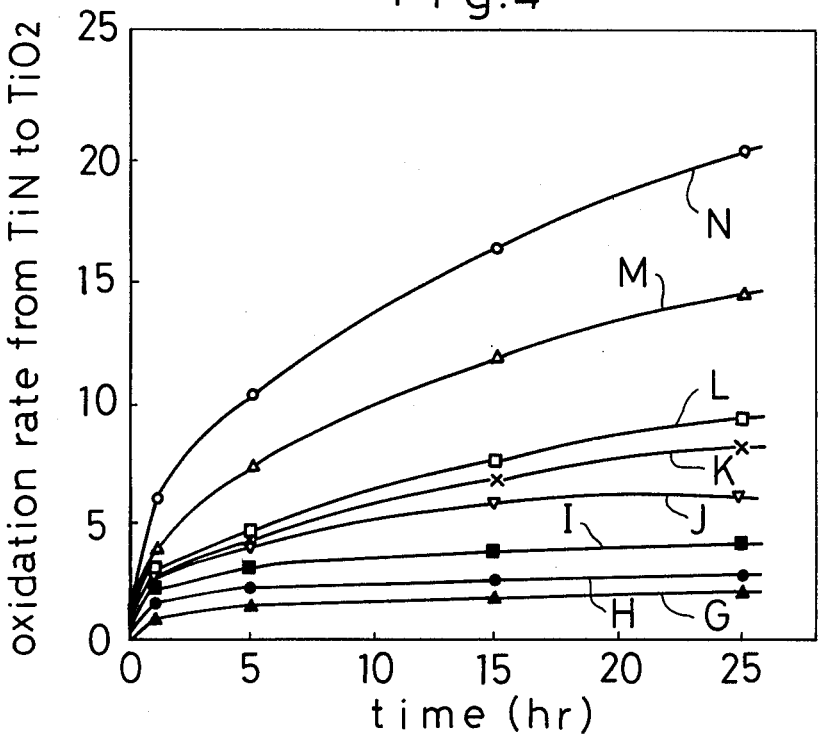

FIG. 3 and FIG. 4 illustrate the role of added nickel in improving the durability of the sintered body for a ceramic heater. FIG. 3 and FIG. 4 show the relation between the oxidization rate of titanium nitride or tiatinium carbide to titanium oxide and the time required in an atmospheric exposure test at 1000° C. Fourteen sintered bodies have the following compositions. (A)66.5$Al_2O_3$-30TiN-1MgO-25Ni (alumina 66.5%, titanium nitride 30%, magnisium oxide 1%, nickel 2.5%), a similar expression is used for the other described sintered bodies: (B)68$Al_2O_3$-30TiN-1MgO-1Ni, (C)60$Al_2O_3$-30TiN-1MgO, (D)44$Al_2O_3$-50TiN 1MgO-5Ni, (E)50$Al_2O_3$-50TiN, (F)100TiN, (G) 76.5$Al_2O_3$-20TiC-1MgO-2.5Ni, (H)66.5$Al_2O_3$-30TiC-1MgO-2.5Ni, (I) 68Al O-30TiC-1MgO-1Ni, (J)47.5$Al_2O_3$-50TiC-2.5Ni, (K)70$Al_2O_3$-30TiC, (L)60$Al_2O_3$-40TiC, (M)50$Al_2O_3$-50TiC, and (N)100TiC. In this experiment, the test specimens were cubes with dimensions of 5 mm×5 mm×5 mm and the oxidization rate was calculated from weight changes measured with a thermobalance, on the assumption that the weight change is wholly due to the conversion from TiN or TiC to TiO (rutile type). It was confirmed from X-ray diffraction of the oxidation products that TiN and TiC is oxidized to TiO (rutile type). FIG. 3 shows the oxidation rates of sintered bodies (A), (B) and (C), which have the same titanium nitride content of 30% by weight. As shown in the figure, sintered bodies, (A) and (B), which contained 2.5% and 1% of nickel, respectively, ceased to be oxidized after 5 hours of atmospheric exposure. While sintered body C which contained no nickel was still being oxidized even after 15 hours of exposure. As for sintered bodies E and D, both of which include 50 % titanium nitride, the oxidation rate of E with no nickel increased with the elasped time, is similar to F with 100% titanium nitride, but D with 5% nickel ceased to be oxidized after 15 hours. The sintered bodies G, H, and I in FIG. 4 contain 20%, 30%, and 40% of titanium carbide, and 2.5%, 2.5%, and 1% of nickel, respectively. The oxidation rates of these sintered bodies G, H, and I increased for the first 5 hours, but after 5 hours, the increase of the oxidation rates were not noticed. The sintered body J contains 50% of titanium carbide and 2.5% of nickel. The oxidation rate of this sintered body J increased for the first 15 hours, but after 15 hours, it ceased to increase. While the sintered bodies K, L, M and N, which contain no nickel, were being oxidized after 25 hours, with the oxidation rate increasing. Thus, it has been confirmed that nickel serves to prevent further oxidation of the sintered bodies after a certain period. As obvious from the relation:

$$[\text{resistance}] = \frac{[\text{specific resistance}] \times [\text{length}]}{[\text{sectional area}]}$$

the decrease in the sectional area of heating elements, due to oxidization, causes a change in the electrical resistance. Therefore, advance of the oxidation will increase the resistance change. Thus, it is preferable that a stable covering is formed on the surface of the sintered bodies, at least after 20 hours of use.

For reference, Table 2 and Table 3 show the specific resistances of the sintered bodies at room temperature.

Since the ceramic heater of the present invention is chiefly made of alumina, the cost of the raw materials is significantly lower than that of the conventional ceramic heaters which employ silicon carbide, lanthanum chromite, molybdenum disilicide, etc. The specific resistances, bending strengths, and coefficients of thermal expansion of a typical ceramic heater of the present invention and a conventional heater are shown in Table 4.

TABLE 2

| No | $Al_2O_3$ (%) | TiN (%) | MgO (%) | Ni (%) | specific resistance (Ωcm) |
|---|---|---|---|---|---|
| 1 | 0 | 100 | 0 | 0 | $9.4 \times 10^{-5}$ |
| 2 | 20 | 80 | 0 | 0 | $1.2 \times 10^{-4}$ |
| 3 | 50 | 50 | 0 | 0 | $7.3 \times 10^{-4}$ |
| 4 | 70 | 30 | 0 | 0 | $6.5 \times 10^{-3}$ |
| 5 | 80 | 20 | 0 | 0 | $1.8 \times 10^{-1}$ |
| 6 | 90 | 10 | 0 | 0 | 2.7 |
| 7 | 92.5 | 7.5 | 0 | 0 | 3.4 |
| 8 | 65 | 30 | 5.0 | 0 | $1.2 \times 10^{-2}$ |
| 9 | 67 | 30 | 3.0 | 0 | $6.7 \times 10^{-3}$ |
| 10 | 67.5 | 30 | 2.5 | 0 | $5.3 \times 10^{-3}$ |
| 11 | 69.0 | 30 | 1.0 | 0 | $5.1 \times 10^{-3}$ |
| 12 | 69.5 | 30 | 0.5 | 0 | $5.0 \times 10^{-3}$ |
| 13 | 62.5 | 30 | 0 | 7.5 | $1.3 \times 10^{-2}$ |
| 14 | 65.0 | 30 | 0 | 5.0 | $1.6 \times 10^{-3}$ |
| 15 | 67.5 | 30 | 0 | 2.5 | $2.3 \times 10^{-3}$ |
| 16 | 69.0 | 30 | 0 | 1.0 | $3.5 \times 10^{-3}$ |
| 17 | 69.5 | 30 | 0 | 0.5 | $4.6 \times 10^{-3}$ |
| 18 | 88.0 | 10 | 1 | 1.0 | 2.5 |
| 19 | 86.5 | 10 | 1 | 2.5 | 1.5 |
| 20 | 78.0 | 20 | 1 | 1.0 | $1.5 \times 10^{-1}$ |
| 21 | 76.5 | 20 | 1 | 2.5 | $9.4 \times 10^{-2}$ |
| 22 | 68.0 | 30 | 1 | 1.0 | $3.3 \times 10^{-3}$ |
| 23 | 66.5 | 30 | 1.0 | 2.5 | $2.1 \times 10^{-3}$ |
| 24 | 64.0 | 30 | 1.0 | 5.0 | $1.4 \times 10^{-3}$ |
| 25 | 65.0 | 30 | 2.5 | 2.5 | $2.3 \times 10^{-3}$ |
| 26 | 62.5 | 30 | 2.5 | 5.0 | $1.6 \times 10^{-3}$ |
| 27 | 56.5 | 40 | 1.0 | 2.5 | $1.5 \times 10^{-4}$ |
| 28 | 54.0 | 40 | 1.0 | 5.0 | $1.1 \times 10^{-4}$ |

TABLE 3

| No | $Al_2O_3$ (%) | TiC (%) | MgO (%) | Ni (%) | specific resistance (Ωcm) |
|---|---|---|---|---|---|
| 1 | 0 | 100 | 0 | 0 | $2.5 \times 10^{-5}$ |
| 2 | 20 | 80 | 0 | 0 | $1.7 \times 10^{-4}$ |
| 3 | 50 | 50 | 0 | 0 | $1.3 \times 10^{-3}$ |
| 4 | 70 | 30 | 0 | 0 | $4.0 \times 10^{-3}$ |
| 5 | 80 | 20 | 0 | 0 | $6.2 \times 10^{-3}$ |
| 6 | 82.5 | 17.5 | 0 | 0 | $5.1 \times 10^{-2}$ |

TABLE 3-continued

| No | $Al_2O_3$ (%) | TiC (%) | MgO (%) | Ni (%) | specific resistance (Ωcm) |
|---|---|---|---|---|---|
| 7 | 85 | 15 | 0 | 0 | $1.9 \times 10^{-1}$ |
| 8 | 90 | 10 | 0 | 0 | $3.8 \times 10^{-3}$ |
| 9 | 65 | 30 | 5.0 | 0 | $7.7 \times 10^{-3}$ |
| 10 | 67 | 30 | 3.0 | 0 | $3.9 \times 10^{-3}$ |
| 11 | 67.5 | 30 | 2.5 | 0 | $3.3 \times 10^{-3}$ |
| 12 | 69 | 30 | 1.0 | 0 | $3.2 \times 10^{-3}$ |
| 13 | 69.5 | 30 | 0.5 | 0 | $3.4 \times 10^{-3}$ |
| 14 | 78.8 | 20 | 1.2 | 0 | $4.9 \times 10^{-3}$ |
| 15 | 19.8 | 80 | 0.2 | 0 | $1.3 \times 10^{-4}$ |
| 16 | 69.5 | 30 | 0 | 0.5 | $2.8 \times 10^{-3}$ |
| 17 | 69.0 | 30 | 0 | 1.0 | $2.2 \times 10^{-3}$ |
| 18 | 67.5 | 30 | 0 | 2.5 | $1.5 \times 10^{-3}$ |
| 19 | 65.0 | 30 | 0 | 5.0 | $3.9 \times 10^{-4}$ |
| 20 | 62.5 | 30 | 0 | 7.5 | $4.7 \times 10^{-3}$ |
| 21 | 78.2 | 20 | 0 | 1.8 | $2.3 \times 10^{-3}$ |
| 22 | 46.8 | 50 | 0 | 4.2 | $4.9 \times 10^{-4}$ |
| 23 | 58.0 | 40 | 1 | 1.0 | $5.1 \times 10^{-4}$ |
| 24 | 56.5 | 40 | 1 | 2.5 | $3.6 \times 10^{-4}$ |
| 25 | 54.0 | 40 | 1 | 5.0 | $8.9 \times 10^{-5}$ |
| 26 | 52.5 | 40 | 2.5 | 5.0 | $9.0 \times 10^{-5}$ |
| 27 | 68.0 | 30 | 1 | 1.0 | $1.8 \times 10^{-3}$ |
| 28 | 66.5 | 30 | 1 | 2.5 | $1.3 \times 10^{-3}$ |
| 29 | 64.0 | 30 | 1 | 5.0 | $3.0 \times 10^{-4}$ |
| 30 | 78.0 | 20 | 1 | 1.0 | $1.4 \times 10^{-3}$ |
| 31 | 76.5 | 20 | 1 | 2.5 | $9.5 \times 10^{-4}$ |
| 32 | 74.0 | 20 | 1 | 5.0 | $2.5 \times 10^{-4}$ |
| 33 | 72.5 | 20 | 2.5 | 5.0 | $2.8 \times 10^{-4}$ |

Table 5 shows specific resistance of ceramic heaters of the present invention with the composition of $69Al_2O_3$-30TiN-1MgO-1Ni and $68Al_2O_3$-30TiC-1MgO-1Ni at 3 different temperatures, i.e. room temperature, 500° C. and 1000° C. In order to obtain a ceramic heater with a longer life and a lower cost through improvement of the sintering characteristics and oxidation resistance, the present invention does not provide restrictions to additive agents, such chromium carbide, etc.

The sintered bodies of the present invention are made as follows.

For example, the raw materials as shown in Table 2 and Table 3 were crushed and mixed together in a ball mill, then blended with an organic binder such as polyvinyl butyral to form a slurry. The dried slurry was granulated into uniform granules and then pressed into thin plates. The plates were sintered in a nitrogen atmosphere for two hours at 1750° C.-1790° C., to produce the sintered bodies with resistances shown in Table 2 and Table 3.

TABLE 4

| | specific resistance (Ωcm) | bending strength ($kg/mm^2$) | coefficients of thermal expansion (°C.$^{-1}$) |
|---|---|---|---|
| commercialized SiC heating element | 0.5~1 (at 25° C.) 0.08 0.1 (at 1000° C.) | 5~10 (at 25° C.) | $4.5 \times 10^{-6}$ |
| commercialized molybdenum sylicide | $3 \times 10^{-5}$ (at 25° C.) $2.2 \times 10^{-4}$ (at 1000° C.) | 45 | $7 \sim 8 \times 10^{-6}$ |
| $Al_2O_3$—30TiN—1MgO—1Ni | $3.3 \times 10^{-3}$ | 51~57 | |
| $Al_2O_3$—40TiN—1MgO—2.5Ni | $9.4 \times 10^{-2}$ | 45~51 | $5.3 \sim 5.8 \times 10^{-6}$ |
| $Al_2O_3$—20TiN—1MgO—1Ni | $1.5 \times 10^{-1}$ | 40~46 | |
| $Al_2O_3$—30TiC—1MgO—1Ni | $1.8 \times 10^{-3}$ | 50~55 | |
| $Al_2O_3$—30TiC—1MgO—2.5Ni | $1.3 \times 10^{-3}$ | 53~60 | |
| $Al_2O_3$—40TiC—1MgO—1Ni | $5.1 \times 10^{-4}$ | 35~43 | $5.2 \sim 5.6 \times 10^{-6}$ |
| $Al^2O_3$—20TiC—1MgO—1Ni | $1.4 \times 10^{-3}$ (at 25° C.) | 40~45 (at 25° C.) | |

TABLE 5

| | temperature (°C.) | room temperature | 500 | 1000 |
|---|---|---|---|---|
| $68Al_2O_3$—30TiN—1MgO—1Ni | specific resistance (Ωcm) | $3.3 \times 10^{-3}$ | $3.9 \times 10^{-3}$ | $4.7 \times 10^{-3}$ |
| $68Al_2O_3$—30TiC—1MgO—1Ni | specific resistance (Ωcm) | $1.8 \times 10^{-3}$ | $2.6 \times 10^{-3}$ | $3.4 \times 10^{-3}$ |

Generally, the first step to produce the sintered body of the present invention; comprising titanium nitride and/or titanium carbide, and alumina, is to prepare a raw powdery mixture of these ingredients by pulverising and mixing. The proportion of the ingredients may be decided according to desired purpose of use. In order to produce a bar-shaped ceramic heater, granulated powders may be pressed into a mold to make a compressed body. In order to produce a thin plate ceramic heater, a liquid may be added to the powdery mixture to make paste and a doctor blade is used to form a thin plate made of the paste, which is punched to form a thin green compact with a desired shape.

In order to produce a printed heater, the paste may be screen-printed on a substrate. The green compacts described above are then sintered at 1650° C.–1850° C., more preferably at 1750°–1800° C., after a drying process, if required. The sintering may be carried out in non-oxidative or inert atmosphere, or in vacuum below $10^{-2}$ Torr to prevent titanium nitride and titanium carbide from being oxidized. The ceramic heaters or heating elements of the present invention can be produced by the method described above.

The ceramic heaters can be produced also by hot pressing at high tempretures and under high pressures in order to improve the sintering characteristics, although atmospheric sintering is only described in this description. Table 6 shows the specific resistances of the ceramic heaters produced by hot pressing each of $Al_2O_3$-30TiN-1MgO-1Ni and $Al_2O_3$-30TiC-1MgO-1Ni mixtures at 250 kg/cm$^2$ and at 1650° C. for twenty minutes.

According to the invention, the sintered heating element comprising titanium nitride and/or titanium carbide and alumina can be bonded to or covered with a supporting material. Alumina is one of the ingredients of the heating element.

TABLE 6

| | Ni (%) | 0 | 0.5 | 1.0 | 2.5 | 5.0 | 7.5 |
|---|---|---|---|---|---|---|---|
| $Al_2O_3$—30TiN—1MgO—xNi | specific resistance (Ωcm) | $2.3 \times 10^{-3}$ | $1.7 \times 10^{-3}$ | $1.3 \times 10^{-3}$ | $8.7 \times 10^{-4}$ | $6.1 \times 10^{-4}$ | $6.5 \times 10^{-3}$ |
| $Al_2O_3$—30TiC—1MgO—xNi | specific resistance (Ωcm) | $1.1 \times 10^{-3}$ | $8.5 \times 10^{-4}$ | $6.2 \times 10^{-4}$ | $4.5 \times 10$ | $1.1 \times 10^{-4}$ | $3.7 \times 10^{-3}$ |

Therefore the heating element can be bonded strongly to the supporting substrate of alumina.

Also the coefficient of thermal expansion of alumina is $8.0 \times 10^{-6}$° C.$^{-1}$ which is very close to the coefficients of titanium nitride and titanium carbide: $9.3 \times 10^{-6}$° C.$^{-1}$ and $7.6 \times 10^{-6}$° C.$^{-1}$ Therefore, the distortions caused by the difference between the heating element and supporting substrate is small and the separation of them occurs less often.

A ceramic heater, which has a heating element covered with a supporting substrate, has a longer life because the covering substrate protects the heating element from oxidization. The ceramic heater needs at least a pair of terminals which connect with at least two points on the surface of the heating element. Namely, the covering substrate may cover all the surface of heating element except the surface connected with the terminals.

The heater element may be either board-shaped or line-shaped. The thickness, width, and shape can be adequately selected according to the amount of heating and the shape of the requisite heated parts of the desired heater. And more than two layers of heater element can be stratified. The amount of heating can be also controlled by changing the composition of the heater element, or the voltage between terminals.

The covering substrates act to prevent the heater element from being exposed to a corrosive atmosphere by covering the surface of the heater. Thereby the covering substrate may be very thin. And when the heater elements are extremely thin, the covering substrates may be locally thickened in order to increase the strength of the whole ceramic heater.

The terminals are generally made of copper, nickel or chromium alloy. The terminals are shrinkage fitted or formed by metalizing.

One method for manufacturing the heater is that green compacts or sintered bodies of the both heating and covering substrates are made respectively, thereafter, they are combined and sintered to form a unit.

Another method is that the raw paste of a heater element is printed of a part of the surface of the sintered covering substrate, then the other part of the covering substrate is covered, thereafter they are sintered. When the heating element is wholly covered with the covering substrate, and is not in contact with the atmospheric gas, it is possible to be sintered in the air.

As the ceramic heater with the covering substrate has the inherent advantages described above, it can be used as a temperature compensation heater of the cigarette-lighter and an oxidation sensor of cars.

EMBODIMENT 1

Figure 5:
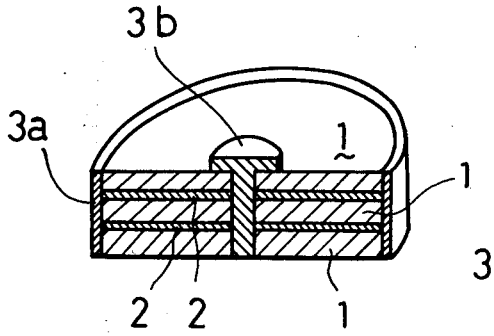
FIG. 5 is a partially cutaway perspective view of a ceramic heater described in the first embodiment.

The first preferred embodiment of the ceramic heater is illustrated in FIG. 5. The ceramic heater is composed of three substrates 1, two heater elements 2, a circumferential ring-shaped terminal 3*a* and a center terminal 3*b*. The substrates 1 are in a shape of a disk and have a center hole. The heater elements 2 have the similar shape as the substrates 1. The substrates 1 are made of sintered alumina, and the heater elements 2 are composed of a sintered body of the powdery mixture of titanium carbide and alumina. The ring-shaped is made of nickel-chromium alloy and the center terminal 3b is a sintered nickel-chromium alloy.

To produce the ceramic heater of the present invention, the green compacts of the substrates and heater elements are formed by compressing each raw powder. Then the green compacts are stratified as shown in FIG. 5 and sintered integrally. A ring of nickel-chromium alloy, which forms the terminal 3a, is shrinkage fitted to the outer circumference of the resulting sintered compact. Next, nickel-chromium powder is stuffed in the center hole of the sintered compact and heated to sinter the powder. Thus center terminal 3b is formed.

In the present embodiment, the two upper and lower covering substrates 1,1 protect the heater elements 2,2 from an external atmosphere. The middle substrate 1 acts to be an insulater between the heater elements 2,2. And the voltage is induced between the terminal 3a and 3b, thereby the current flows in the heater elements 2,2 which emit heat.

In this embodiment, the substrates are made of sintered alumina and the heating elements are made of a sintered mixture of alumina and titanium carbide. The alumina component of the heating elements combines the alumina forming the substrates, and strengthens the coupling between the covering substrates and the heating elements.

To keep a higher coupling stability of the substrates and heating elements, the material used for forming the heating elements should contain from 50 to 90% by weight of alumina.

In order to protect the heating elements 22 from an external atmosphere or to act safely as an insulater, the thickness of the covering substrates 1 is preferablly 0.5–2 mm.

In the present embodiment, the specific resistances of the heater element can be optionally adjusted within $10^5$ to several Ωcm by changing the sintering condition, the thickness of heater element, and the formation formulation of the raw materials.

EMBODIMENT 2

Figure 6:
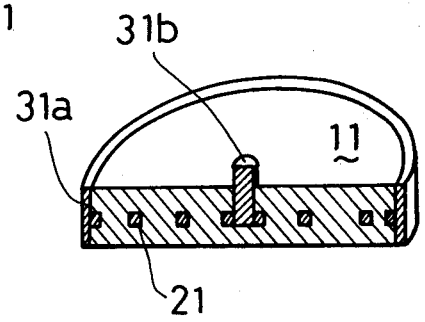
FIG. 6 is a partially cutaway perspective view of a ceramic heater described in the second embodiment.

The second preferred embodiment of the ceramic heater is illustrated in FIG. 6. This ceramic heater is composed of a covering substrate 11, a voluted heater element 21 embeded in the substrates 11, and terminals 31a and 31b.

To produce the ceramic heater, an upper portion and a lower portion, which form the covering substrate 11, are made to be a pair of green compacts of alumina and a green compact for the heating element 21 is made of titanium nitride and/or titanium carbide and alumina. Then the green compact for the heating elements is sandwiched between the pair of green compacts and the whole are put into and pressed again in a mold. Then they are fired integrally, and terminals are formed in the same way as the first embodiment.

The resulting ceramic heater is both oxidation resistive and resistant to thermal shock as is the first embodiment.

Instead of the two green compacts, a slurry made of water and alumina powder can be used for the covering substrates. The slurry is formed for the lower substrate 11, by means of doctor blade. Upon the substrate 11, the green compact for heater element 21 is layed, then the upper covering substrate 11 is made of a slurry also by means of a doctor blade. The whole is dried and sintered, and terminals are formed in the same process. Thus the ceramic heater can be produced.

EMBODIMENT 3

Figure 7:
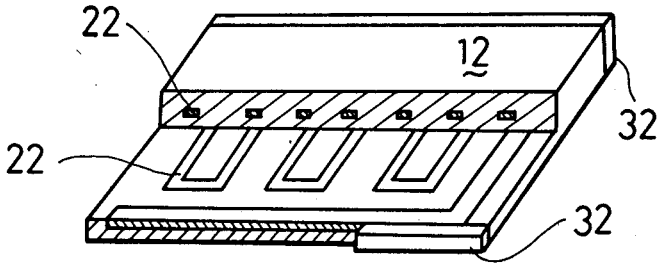
FIG. 7 is a partially broken perspective view of a ceramic heater described in the third embodiment.

The third preferred embodiment of the ceramic heater is illustrated in FIG. 7. This ceramic heater is composed of the covering substrate 12, two zig-zag heater elements 22 embedded in the covering substrate 12, and termenals 32, 32.

To produce the ceramic heater of the present embodiment, on one side of the rectangular green compact of alumina, a paste of titanium nitride and/or titanium carbide and alumina is printed in a zig-zag form, then two of these printed plates are stratified, and a green compact of the same shape, which is not printed, is layed upon them. These are integrally sintered at 1600°–1650° C. after first being pressed into a mold, thereafter terminals 32 and 32 are formed by means of metalizing.

The heater elements 22 are embeded in the covering substrate 12, therefore the ceramic heater of the present embodiment is characterized by an excellent oxidative resistance and anti-thermal shock.

EMBODIMENT 4

Figure 8:
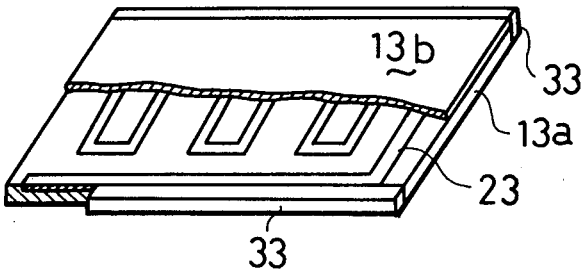
FIG. 8 is a partially broken perspective view of a ceramic heater described in the fourth embodiment.

The fourth preferred embodiment of the ceramic heater is illustrated in FIG. 8. The ceramic heater of the present embodiment is composed of the covering substrates 13a and 13b, the heater element 23, and terminals 33 and 33.

To produce this ceramic heater, a plate of alumina is sintered as the lower substrate 13a, and paste for the heater element 23 is printed in a zig-zag form on the substrate 13a and sintered. The paste is of the same component as described in the third embodiment. The terminals 33 and 33 are produced by means of metalizing. Then the whole is coated with alumina by plasma spraying, which forms the upper covering substrate 13b.

The heater element 23 is embeded in the covering substrates 13a and 13b, therefore the ceramic heater of the present embodiment is characterized by an excellent oxidative resistance and thermal shock resistance.

We claim:

1. A ceramic heater having a heating element composed of a sintered body of a powdery mixture consisting essentially of from 50 to 90% by weight of alumina, from 10 to 50 of a member selected from the group consisting of titanium nitride, titanium carbide and a mixture thereof, and from 0.05 to 7.5% by weight nickel.

2. A ceramic heater according to claim 1, wherein said powdery mixture further contains from 0.05 to 5% by weight magnesium oxide.

3. A ceramic heater according to claim 1, wherein said powdery mixture further contains a member selected from the group consisting of chromium, chromium carbide and a mixture thereof.

4. A ceramic heater according to claim 1, wherein said heating element is positioned on an insulating support substrate.

5. A ceramic heater according to claim 4, wherein said heating element is covered with an insulating covering substrate except the surfaces connected with at least a pair of terminals.

6. A ceramic heater according to claim 5, wherein said substrates are sintered alumina.

7. A ceramic heater according to claim 4, wherein said substrate is sintered alumina.

* * * * *